US005561499A

United States Patent [19]

Setoriyama

[11] Patent Number: 5,561,499

[45] Date of Patent: Oct. 1, 1996

[54] DIRECT ELECTRICAL CONNECTION SYSTEM AND RELATED METHOD FOR AN IMAGE FORMING APPARATUS

[75] Inventor: Takeshi Setoriyama, Yokohama, Japan

[73] Assignee: Canon Kabushiki Kaisha, Tokyo, Japan

[21] Appl. No.: 161,446

[22] Filed: Dec. 6, 1993

Related U.S. Application Data

[63] Continuation of Ser. No. 909,761, Jul. 7, 1992, abandoned.

[30] Foreign Application Priority Data

Jul. 9, 1991 [JP] Japan ..... 3-168305
Jun. 25, 1992 [JP] Japan ..... 4-167709

[51] Int. Cl.[6] ..... G03G 15/00; G03G 21/00

[52] U.S. Cl. ..... 355/202

[58] Field of Search ..... 355/200, 202, 355/203, 204, 210, 260; 439/246, 247, 248, 252

[56] References Cited

U.S. PATENT DOCUMENTS

| | | | |
|---|---|---|---|
| 4,299,474 | 11/1981 | Ernst et al. | 355/200 |
| 4,307,431 | 12/1981 | Sone et al. | 439/246 X |
| 4,486,091 | 12/1984 | Cestari et al. | 355/295 |
| 4,575,221 | 3/1986 | Onoda et al. | 355/200 |
| 4,690,471 | 9/1987 | Marabotto et al. | 439/246 X |
| 4,921,435 | 5/1990 | Kane et al. | 439/248 |
| 5,001,516 | 3/1991 | Maruyama et al. | 355/202 |
| 5,051,866 | 9/1991 | Osaka | 355/200 X |
| 5,076,794 | 12/1991 | Ganthier | 439/246 X |

FOREIGN PATENT DOCUMENTS

| | | | |
|---|---|---|---|
| 60-150058 | 8/1985 | Japan | 355/200 |
| 61-129656 | 6/1986 | Japan | 355/200 |
| 1-100566 | 4/1989 | Japan | 355/200 |

*Primary Examiner*—Fred L. Braun
*Attorney, Agent, or Firm*—Fitzpatrick, Cella, Harper & Scinto

[57] ABSTRACT

An image forming apparatus for forming an image on a recording medium includes a feeding device for feeding the recording medium, an electrical equipment unit protruding outwardly in a horizontal direction from a conveying path and having a size greater than that of a maximum recordable recording medium fed by tile feeding device where the equipment unit is positioned below a mount portion of an image bearing member, the electrical equipment unit having a conductive member for contacting the image bearing member to ground the image bearing member, and a conduit, which is electrically connectable to the electrical equipment unit.

31 Claims, 6 Drawing Sheets

DIRECT ELECTRICAL CONNECTION SYSTEM AND RELATED METHOD FOR AN IMAGE FORMING APPARATUS

This application is a continuation, of application Ser. No. 07/909,761 filed Jul. 7, 1992 now abandoned.

BACKGROUND OF THE INVENTION

1. Field of the Invention

The present invention relates to an image forming system for forming an image on a recording medium. Here, the image forming system may be, for example, an electrophotographic machine, printer, word processor, facsimile and the like.

2. Related Background Art

The present invention relates to an image forming system such as a laser beam printer, copying machine and the like utilizing an electrophotographic method or other recording methods. Now, as an example of image forming systems, a laser beam printer will be described hereinafter.

An example of conventional laser beam printers will be explained with reference to FIG. 6.

A frame 100 of a conventional laser beam printer comprises a lower body 100*a*, and an upper body 100*b* pivotally mounted on the lower body 100*a* via a pivot shaft 101 for opening and closing movement with respect to the lower body. Within the lower body 100*a*, there are disposed a sheet supply cassette 110, a sheet supply roller 111, first and second feed rollers 112, 113, a transfer charger 114, a fixing device 115, a transfer sheet feeding path 116, an AC/DC power source unit 117 and a high voltage power source 118. On the other hand, within the upper body 100*b*, there are disposed a process cartridge 119, a laser scanner 120, a reflection mirror 121 and ejector rollers 122. Further, a control circuit, an image signal process circuit and the like are arranged on a side of the frame 100.

However, in the above-mentioned image forming system the laser beam printer has the following drawback.

That is to say, conventionally, the AC/DC power source unit and the control circuit, image signal process circuit, process cartridge, transfer charger, driving mechanism, fixing device, high voltage power source and the like were arranged separately. Thus, the power source unit and control circuit were electrically connected to the other units via harnesses.

Accordingly, in assembling the image forming system, a numerous number of parts were required and it took a long time to assemble the system.

SUMMARY OF THE INVENTION

Accordingly, an object of the present invention is to provide an image forming system which can reduce the number of parts and improve the reliability considerably..

Another object of the present invention is to provide an image forming system which can improve the assembling operability to reduce the assembling time.

The other object of the present invention is to provide an image forming system which can eliminate the above-mentioned conventional drawback, does not need any harness, and can easily achieve the reduction of the number of parts, the improvement of the assembling and/or service operability, the improvement of the reliability and cost-down.

DETAILED DESCRIPTION OF THE PREFERRED EMBODIMENTS

The present invention will now be explained in connection with an embodiment of a laser beam printer, which is an example of an image forming system of electrophotographic type, for performing the recording by scanning a photosensitive member with a laser light beam.

Incidentally, in the embodiment described hereinbelow, an image signal process circuit arranged in a first frame body can be directly connected to electrical parts arranged in a second frame body via connectors, by increasing a width of an electrical equipment unit (including an AC power source, a DC power source, a high voltage power source, a control circuit and the like) for performing the feed and control with respect to an image forming system greater than a width of a maximum recordable recording sheet.

According to this embodiment, it is possible to obtain the easy and direct electrical connection to the other units without any intermediate harnesses.

Further, by using a connector movable by about 0.5–1 mm in all of X, Y and Z directions, the connecting operability can be further facilitated and the reliability of the connections can be further improved.

Figure 1:
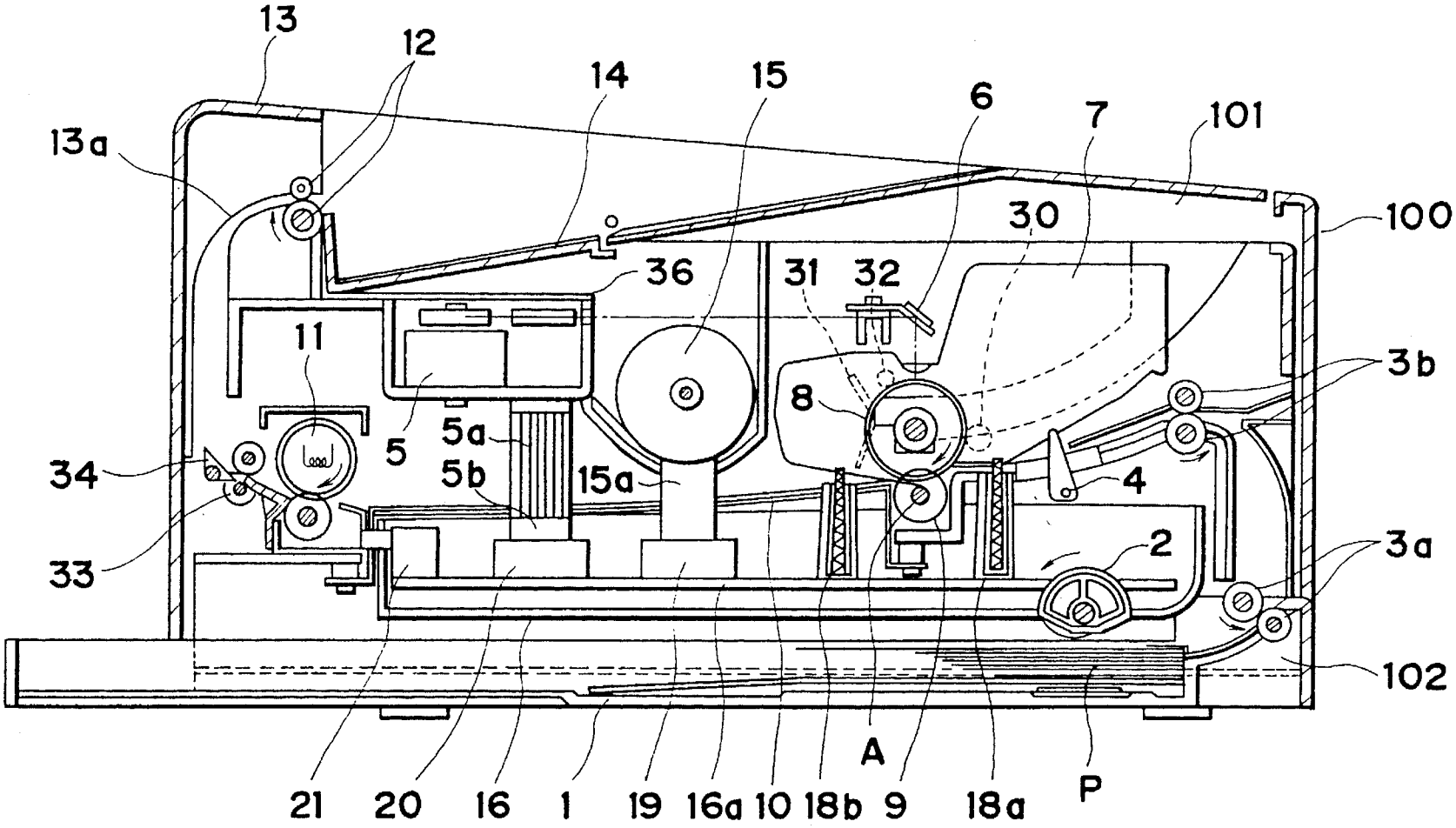
FIG. 1 is all elevational sectional view of an image forming system according to a preferred embodiment of the present invention.
Figure 2:
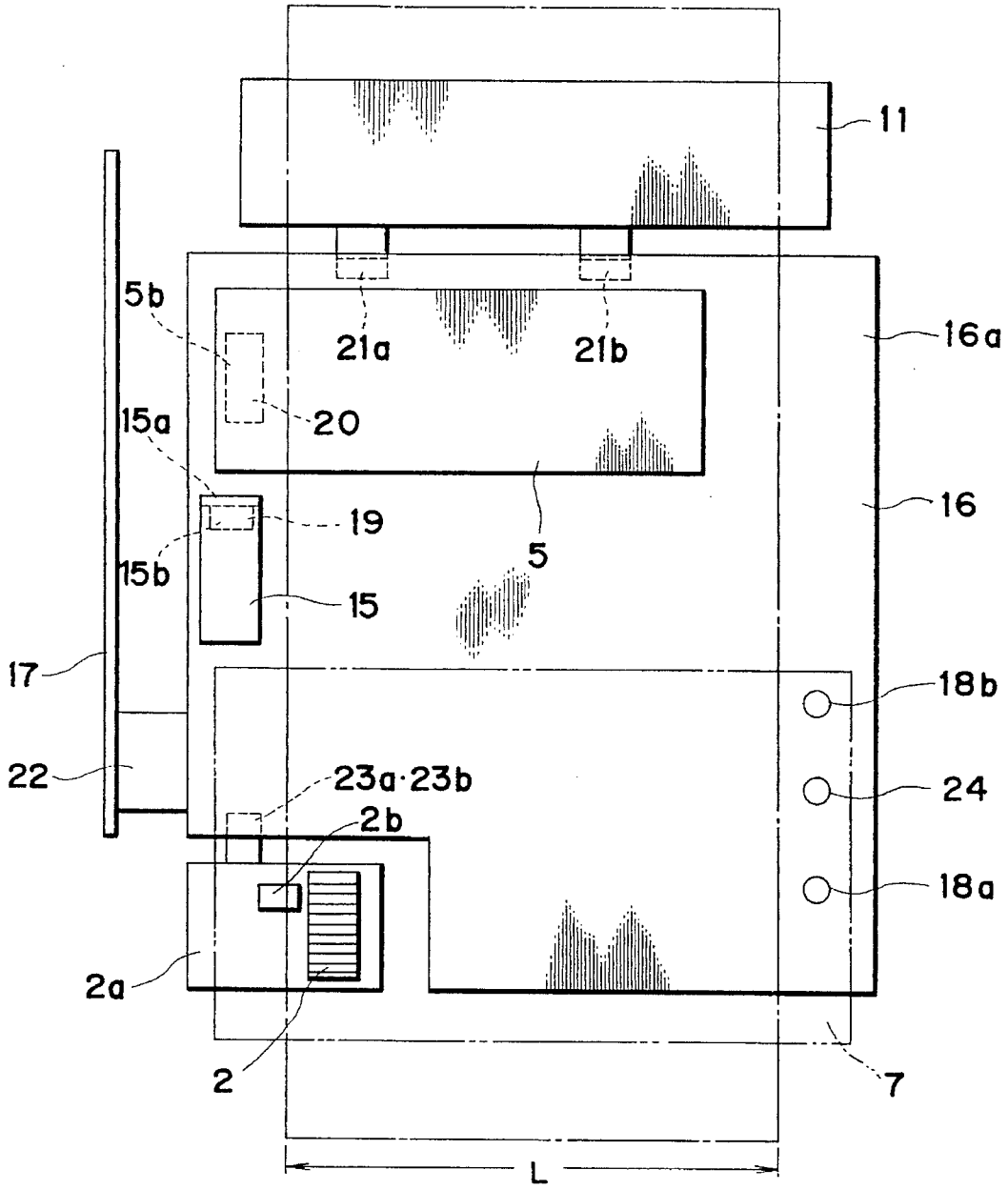
FIG. 2 is a plan view showing the arrangement of main units of the image forming system of FIG. 1.
Figure 3:
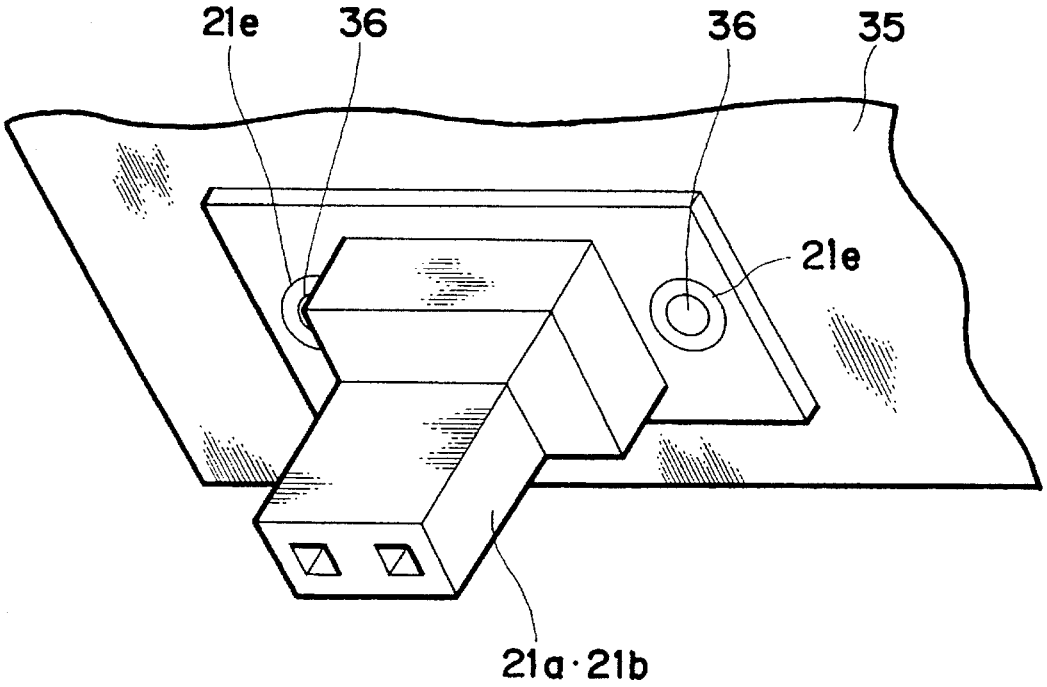
FIG. 3 is a perspective view which can be applied to the image forming system of FIG. 1.
Figure 4:
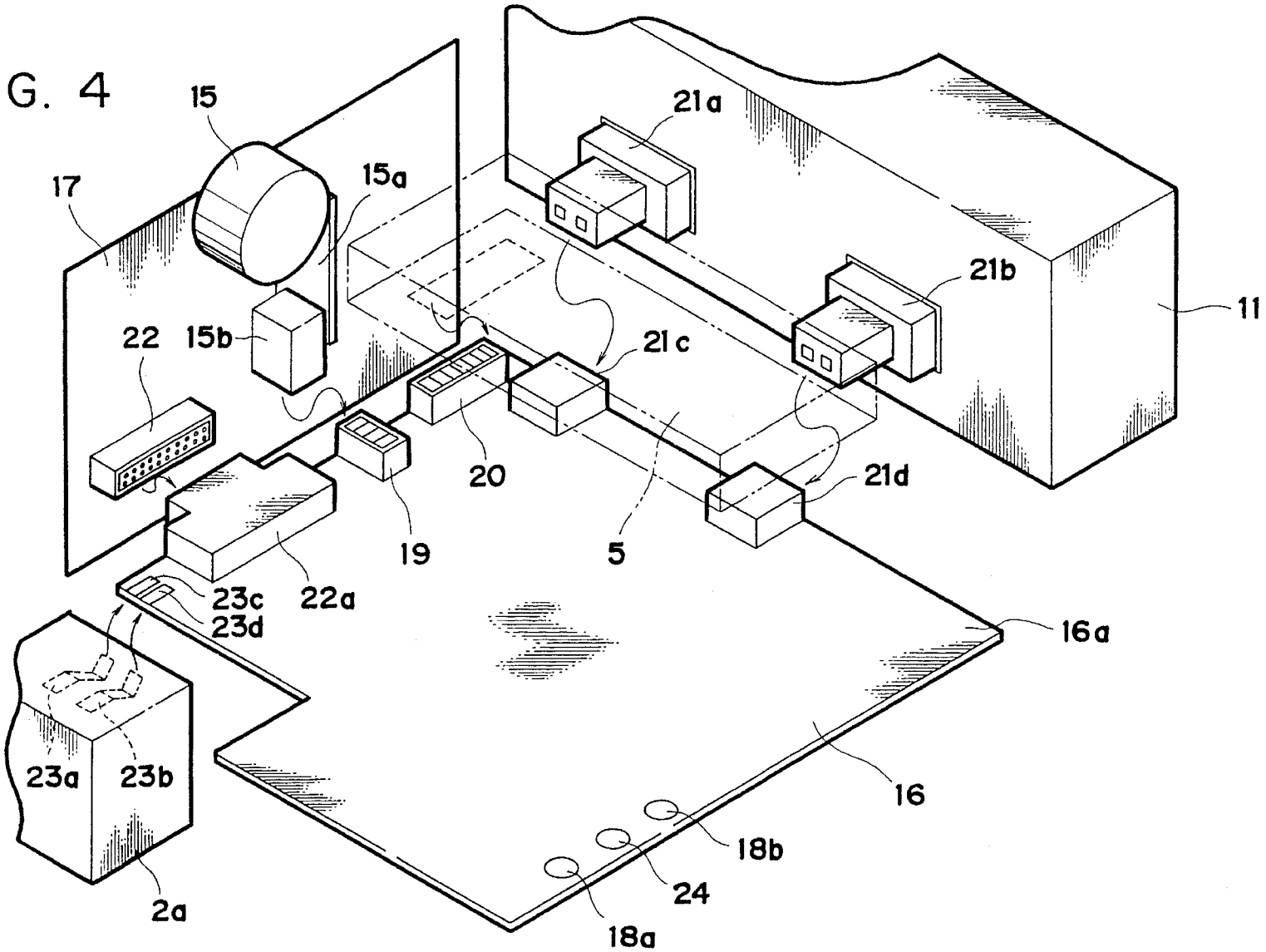
FIG. 4 is a perspective view showing the arrangement of units and the connection between the units in the image forming system of FIG. 1.
Figure 5:
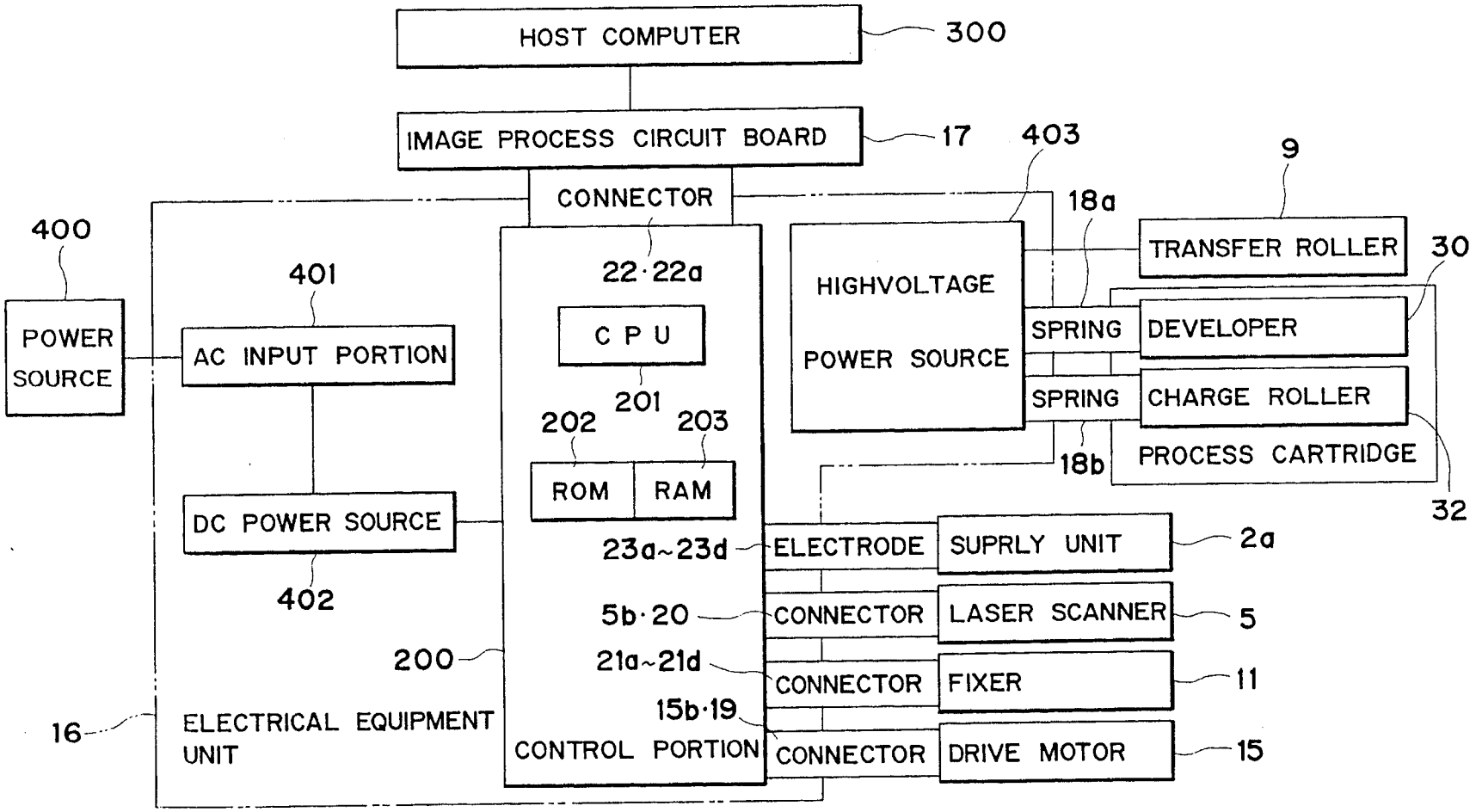
FIG. 5 is a schematic functional block diagram of the image forming system.

Now, FIG. 1 is an elevational sectional view of a laser beam printer as an image forming system according to a preferred embodiment of the present invention, FIG. 2 is a plan view showing the arrangement of main units and the connection between the units in the laser beam printer, FIG. 3 is a perspective view showing an example of a connector used for the electrical connection between an electrical equipment unit and other units, FIG. 4 is a perspective view showing the arrangement of the units and the connection between the units, and FIG. 5 is a schematic functional block diagram.

In these Figures, a cassette 1, which can be removably mounted within a laser beam printer 100, includes stacked recording sheets P (for example, recording paper sheets, OHP sheets and the like) therein. The recording sheets P are separated one by one by the rotation of a sheet supply roller 2 disposed at an upper front side of the inserted cassette 1, and the separated recording sheet is supplied. The supplied recording sheet is sent to a transfer portion A by the rotation of feed rollers 3*a*, 3*b*.

A regist sensor 4 serves to synchronize a position of a leading end of the recording sheet P with the light emitting timing of a laser scanner 5, thereby starting the recording operation from a predetermined position on the recording sheet P.

A reflection mirror 6 serves to deflect the light emitted from the laser scanner 5 toward a photosensitive drum 8. A process cartridge 7 includes therein the photosensitive drum 8, a developing device (developer) 30, a cleaner 31, a charger 32 and the like and can be removably mounted within the laser beam printer. Incidentally, the reference numeral 9 denotes a transfer roller for transferring a visualized image formed on the photosensitive drum 8 onto the recording sheet P; and 10 denotes a sheet feed guide for guiding the recording sheet P from the transfer portion A to a fixing device (fixer) 11, where the visualized image transferred to the recording sheet P is thermally fixed to the recording sheet. After the fixing operation, the recording sheet P is directed to feed rollers 33 and a guide 34, and then is ejected onto an ejection tray 14 by means of ejector rollers 12 while being guided along a guide portion 13*a* integrally formed with an outer cover 13.

All of the units such as the process cartridge 7 and the fixing device 11 and the sheet supply roller 2 are driven by a drive motor 15. An electrical equipment unit 16 comprises an AC input portion 401 for receiving an AC power from an external commercial power source 400 and for eliminating noise, a DC power source 402 for converting the AC power source into a DC power source of 5 V or 24 V and the like, a high voltage power source 403 for supplying the power to the process cartridge 7 (developing device or developer 30 and charge roller or charger roller 32) and the transfer roller 9, and a control portion 200 such as a CPU for controlling the whole operation of the laser beam printer, i.e., an electrical control portion. These elements 401–403 and 200 are mounted on a single printed circuit with high density to form the electrical equipment unit 16. An image process circuit board 17 is arranged perpendicular to the electrical equipment unit 16 and serves to process or treat an image such as character and/or symbol on the basis of a signal from a host computer 300.

Figure 6:
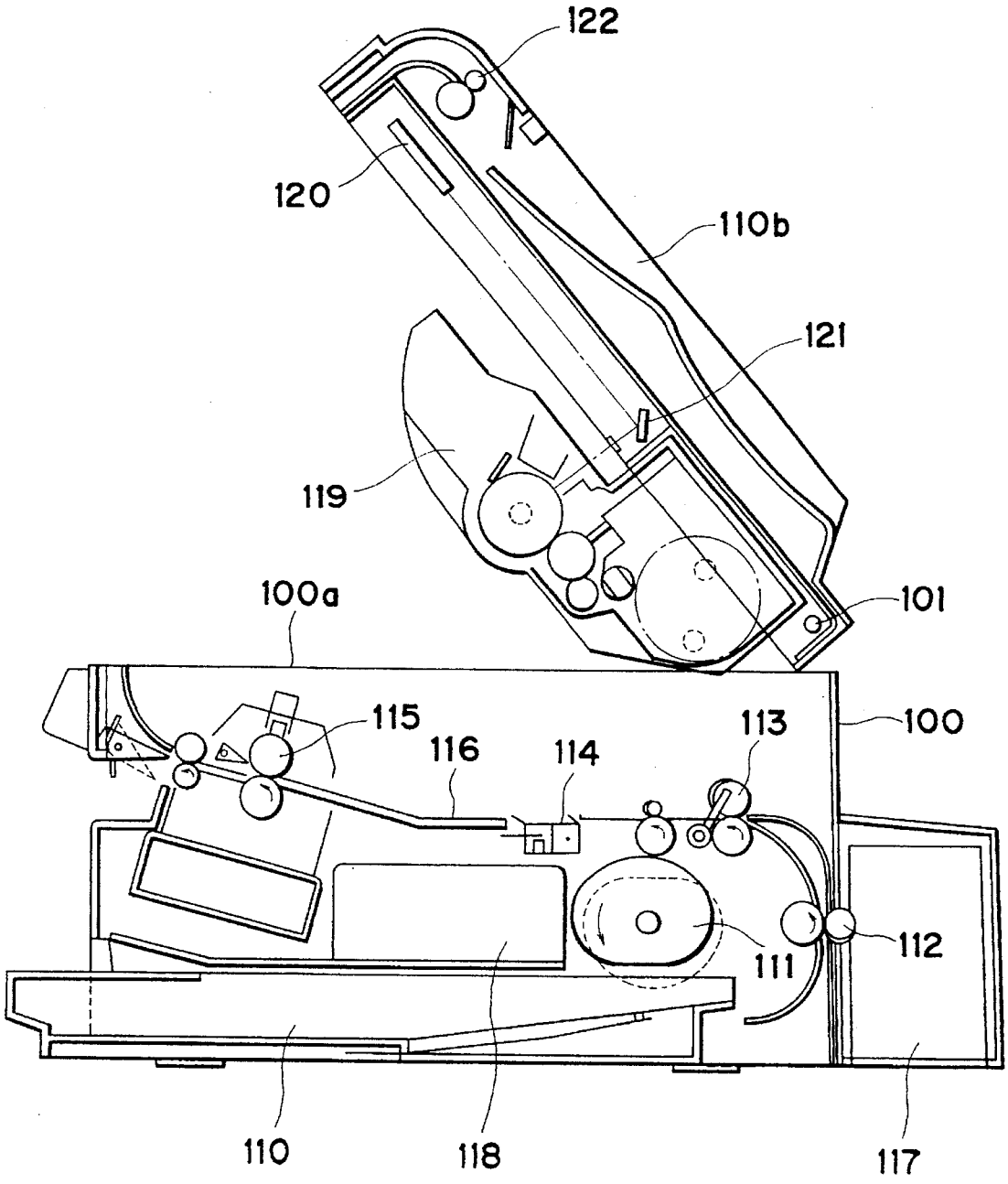
FIG. 6 is an elevational sectional view of a conventional laser beam printer.

Incidentally, similar to the conventional example shown in FIG. 6, in the laser beam printer according to this embodiment, the laser beam printer 100 can be divided into an upper body 103 and a lower body 102 (That is, the upper body can be opened with respect to the lower body), and the upper body 103 includes therein the process cartridge 7, exposure unit 36 and the like, and the lower body 102 includes therein the electrical equipment unit 16 and the like.

Next, the electrical connection between the electrical equipment unit 16 and the other units will be explained.

A sheet supply unit 2*a* is connected to the electrical equipment unit by contacting contact electrodes 23*a*, 23*b* (made of bronze phosphide, SUS or the like, for example) of the sheet supply unit with electrode portions 23*c*, 23*d* on an electrical equipment substrate 16*a* of the electrical equipment unit. By electrically connecting the sheet supply unit 2*a* to the electrical equipment substrate 16*a*, the ON/OFF control of a solenoid 2*b* arranged on the sheet supply unit 2*a* are effected to drive or stop the sheet supply roller 2.

Further, the process cartridge 7 and the transfer roller 9 are electrically connected to the electrical equipment unit via contact springs 18*a*, 18*b*, and 24 (made of SUS, for example) protruding from a portion of the electrical equipment substrate 16*a* greater than a width L (FIG. 2) of a maximum recordable recording sheet, thereby performing the feed or the earthing. Such portion is positioned out of the maximum width L of the sheet. As shown in FIG. 2, since the contact springs 18*a*, 18*b*, and 24 are arranged out of the maximum width L of the recording sheet, i.e., at a portion protruding outwardly in the direction orthogonal to the conveyance direction, they do not interfere with the feeding of the recording sheet. Further, as shown in FIG. 1, by providing the exposure unit 36 above a feeding path for the recording sheet across the feeding sheet, it is possible to utilize the space effectively. Now, the contact spring 18*a* serves to apply the developing bias to the developing device 30, the contact spring 24 serves to earth the photosensitive drum 8, and the contact spring 18*b* serves to apply a voltage to the charger roller 32 for the primary charging.

Furthermore, the drive motor 15 is electrically connected to the electrical equipment unit 16 by-fitting a connector 15*b* on a motor substrate 15*a* arranged at a side of the drive motor 15 into a connector 19 on the electrical equipment substrate 16*a*.

Further, the image process circuit board 17 is electrically connected to the electrical equipment unit 16 at a side thereof by connecting a connector 22, secured to the image process circuit board 17, to a connector 22*a* secured to the electrical equipment unit 16, thereby performing the communication between the image process circuit board 17 and the control portion 200 (CPU 201) in the electrical equipment unit 16.

In addition, the fixing device 11 is connected to the electrical equipment unit 16 below the recording sheet feeding path by connecting an AC connector 21*a* and a DC connector 21*b* secured to the fixing device 11 to an AC connector 21*c* and a DC connector 21*d* secured to the electrical equipment unit 16, thereby effecting the feed and the control regarding the fixing device. Incidentally, as shown in FIG. 3, the connectors 21*a*, and 21*b* are provided at both their ends with holes 21*e* (each having a diameter of about 8 mm in the illustrated embodiment).

Now, the attachment of the connectors 21*a*, and 21*b* to the fixing device 11 will be explained.

Shafts 36 (each having a diameter of about 6 mm in the illustrated embodiment) are provided on a connector holder member 35. The connectors 21*a*, 21*b* are held on the holder member 35 by inserting the shafts 36 into the holes 21*e*. Accordingly, due to the difference in diameter between the shaft 36 and the holes 21*e*, the connectors 21*a*, 21*b* can be moved in all directions in X, Y and Z planes. Further, by providing clearances between the connectors 21*a*, 21*b* and the holder member 35, the movement of the connectors 21*a*, 21*b* in all directions in the X, Y, Z planes is permitted. Incidentally, in the illustrated embodiment, the connectors 21*a*, 21*b* can be moved by about 0.5 mm–1.0 mm in the X, Y and Z directions.

In this way, even if the positional relation between the fixing device 11 and the electrical equipment unit 16 is relatively rough, the connectors can compensate for the discrepancy in the positions between the fixing device 11 and the electrical equipment unit 16, thereby permitting the connection therebetween without applying any stress to the electrical equipment substrate 16*a*. Therefore, the reliability of the assembled printer can be improved.

As mentioned above, the main units in the laser beam printer can be electrically connected to the electrical equipment unit 16 easily and directly without any intermediate harnesses. Thus, it is possible not only to reduce the number of parts such as the harnesses but also to improve the maintenance and assembling operability. Further, any careless misoperation such as the omission in the connections can be prevented, thus improving the reliability of the laser beam printer.

Further, as shown in FIG. 1, the laser scanner 5 is connected to the electrical equipment unit 16 at the outside of the recording sheet feeding path by connecting a connector 5b of a relay substrate 5a to a connector 20 of the electrical equipment substrate 16a. In this way, all of the units in the laser beam printer that must be electrically controlled are connectable to the electrical equipment unit 16. That is to say, the electrical controlling functions required for the laser beam printer can be gathered on the electrical equipment unit 16. Accordingly, by controlling the quality of the electrical equipment unit 16 preponderantly, it is possible to ensure the quality of the image forming system.

Now, the schematic functional block diagram of the laser beam printer according to the illustrated embodiment will be described with reference to FIG. 5.

The control portion 200 controls the whole operation of the laser beam printer and comprises a CPU 201 such as a microprocessor, a ROM 202 for storing a control program for the CPU 201 and various data, and a RAM 203 used as a work area and adapted to temporarily store various data.

The control portion 200 is provided on the electrical equipment substrate 16a of the electrical equipment unit 16 and receives various information from the host computer 300 via the image process circuit board 17. The control portion 200 controls the sheet supply unit 2a, laser scanner 5, transfer roller 9, fixing device 11, drive motor 15, developing device 30 and charger roller 32.

Incidentally, in the illustrated embodiment, while an example that the AC input portion, DC power source, high voltage power source and control circuit portion are mounted on the single printed board to form the electrical equipment unit was explained, it should be understood that each of these elements may be mounted on a respective printed board and these printed boards may be connected to each other to form the electrical equipment unit. Further, the electrical equipment unit does not necessarily include all of the above-mentioned AC input portion, DC power source, high voltage power source and control circuit portion, but may include at least one of these elements. However, it is preferable that the electrical equipment unit includes these elements as much as possible, since an excellent advantage can be obtained by the present invention. Further, in the illustrated embodiment, while the printer of electrophotographic type was explained as the example, the present invention may be effectively applied to a printer of ink jet recording type, a printer of electrostatic recording type or the like.

Furthermore,, the present invention is not limited to the image forming system using the process cartridges, but may be applied to an image forming system not having a process cartridge,. When a process cartridge is used, such process cartridge may be constituted as follows.

That is to say, the process cartridge incorporates therein an image bearing member (for example, electrophotographic photosensitive member and the like), and at least one of a charger means, developing means and cleaning means (process means) as a unit which can be removably mounted within an image forming system. More specifically, the process cartridge incorporates therein a charger means, developing means or cleaning means, and an electrophotographic photosensitive member as a unit, which can be removably mounted within an image forming system; or incorporates therein at least one of a charger means, developing means and cleaning means, and an electrophotographic photosensitive member as a unit, which can be removably mounted within an image forming system; or incorporates therein at least a developing means and an electrophotographic photosensitive member as a unit which can be removably mounted within an image forming system.

As mentioned above, according to the illustrated embodiment, since the electrical equipment unit having the width greater than that of the maximum recordable sheet is arranged between the cassette and the recording sheet feeding path, various units can be directly connected to the electrical equipment unit without any intermediate harnesses, thereby eliminating the harnesses. Further, since the electrical control functions are gathered on the electrical equipment unit, by ensuring the quality of the electrical equipment unit, it is possible to ensure the quality of the image forming system.

As mentioned above, according to the present invention, it is possible to reduce the number of parts and, thus, to improve the assembling operability, there,by providing an image forming system which can achieve the improvement of the reliability thereof.

What is claimed is:

1. An image forming apparatus onto which a process cartridge is removably mountable, said image forming apparatus capable of forming an image onto a recording medium, said image forming apparatus comprising:

mounting means for removably mounting the process cartridge, the process cartridge comprising an electrophotographic photosensitive member, a charging member for charging the electrophotographic photosensitive member, and developing means for developing a latent image formed on the electrophotographic photosensitive member;

recording medium stacking means, disposed at a lowermost portion of said image forming apparatus, for stacking the recording medium on which the image is to be formed;

transfer means for transferring a developed image formed on the electrophotographic photosensitive member of the process cartridge mounted on said mounting means onto the recording medium;

fixing means for fixing the developed image transferred onto tire recording medium by said transfer means;

an electrical equipment unit disposed above said recording medium stacking means and provided protruding outwardly, in a plane parallel to a conveyance path of the recording medium, in a direction orthogonal to a conveyance direction of the recording medium, from a conveyance path that is for a maximum size recording medium upon which an image can be formed, said electrical equipment unit extending from below the process cartridge mounted on said mounting means toward a direction where said fixing means is provided;

a first electrical contact, a second electrical contact, and a third electrical contact, all disposed at an outwardly protruding area of said electrical equipment unit, said first electrical contact being for applying a developing bias to the developing means of the process cartridge, said second electrical contact being for applying a charging bias to the charging member, and said third electrical contact being for earthing the electrophotographic photosensitive member;

a connector provided at an area of said electrical equipment unit where the recording medium is advanced;

a fourth electrical contact disposed at an outwardly protruding area of said electrical equipment unit, for applying a transfer bias to said transfer means; and a recording medium receiving means, disposed above said mounting means, for receiving the recording medium on which the image is formed, wherein the developing bias is applied to the developing means via said first electrical contact, the charging bias is applied to the charging member via said second electrical contact, the electrophotographic photosensitive member is earthed via said third electrical contact, the transfer bias is applied to said transfer means via said fourth electrical contact, and electrical power is applied to said fixing means via said connector, wherein said mounting means is disposed above said electrical equipment unit, and wherein said transfer means transfers a developed image on the electrophotographic photosensitive member to the recording medium fed out from said recording medium stacking means such that a front face and a rear face of the recording medium are reversed relative to when the recording medium is in said recording medium stacking means, said fixing means fixes the developed image transferred to the recording medium by said transfer means when the recording medium passes through said fixing means, and said recording medium receiving means receives the recording medium to which said fixing means has fixed the developed image such that the front face and the rear face of the recording medium are reversed relative to when the recording medium is acted upon by said transfer means.

2. An image forming apparatus according to claim 1, wherein said electrical equipment unit protrudes outwardly in the orthogonal direction from the conveyance path at one side of said electrical equipment unit.

3. An image forming apparatus according to claim 2, wherein said electrical equipment unit comprises an AC power source input portion, a DC power source, a high voltage power source, and a control portion.

4. An image forming apparatus according to claim 2, wherein said electrical equipment unit comprises an AC power source input portion, a DC power source, a high voltage power source, and a control portion, all on a single printed circuit board.

5. An image forming apparatus according to claim 1, wherein said electrical equipment unit protrudes outwardly in the orthogonal direction from the conveyance path at both sides of said electrical equipment unit.

6. An image forming apparatus according to claim 5, wherein said electrical equipment unit comprises a power source and an electrical control circuit, both on a single printed substrate.

7. An image forming apparatus according to claim 5, further comprising a second connector, disposed at an outwardly protruding area of said electrical equipment unit, said second connector being configured to connect to a connector of a relay substrate of a laser scanner.

8. An image forming apparatus according to claim 1, wherein said electrical equipment unit comprises an AC power source input portion.

9. An image forming apparatus according to claim 1, wherein said electrical equipment unit comprises a DC power source.

10. An image forming apparatus according to claim 1, wherein said electrical equipment unit comprises a high voltage power source.

11. An image forming apparatus according to claim 10, wherein said connector comprises an AC connector and a DC connector configured to connect respectively to an AC connector and a DC connector of said fixing means, within an area smaller than a width of the maximum size recording medium.

12. An image forming apparatus according to claim 1, wherein said electrical equipment unit comprises an AC power source input portion, a DC power source, a high voltage power source, and a control portion.

13. An image forming apparatus according to claim 12, further comprising a second connector, disposed at an outwardly protruding area of said electrical equipment unit, said second connector being configured to connect to a connector of an image process circuit board.

14. An image forming apparatus according to claim 12, further comprising a second connector, disposed at an outwardly protruding area of said electrical equipment unit, said second connector being configured to connect to a connector of a relay substrate of a laser scanner.

15. An image forming apparatus according to claim 1, wherein said electrical equipment unit comprises an AC power source input portion, a DC power source, a high voltage power source, and a control portion, all on a single printed circuit board.

16. An image forming apparatus according to claim 15, further comprising a second connector, disposed at an outwardly protruding area of said electrical equipment unit, said second connector being configured to connect to a connector of a relay substrate of a laser scanner.

17. An image forming apparatus according to claim 15, further comprising a second connector, disposed at an outwardly protruding area of said electrical equipment unit, said second connector being configured to connect to a connector of an image process circuit board.

18. An image forming apparatus according to claim 15, further comprising a second connector, disposed at an outwardly protruding area of said electrical equipment unit, said second connector being configured to connect to a connector of a motor substrate.

19. An image forming apparatus according to claim 1, further comprising a second connector, disposed at an outwardly protruding area of said electrical equipment unit, said second connector being configured to connect to a connector of an image process circuit board.

20. An image forming apparatus according to claim 1, further comprising a second connector, disposed at an outwardly protruding area of said electrical equipment unit, said second connector being configured to connect to a connector of a motor substrate.

21. An image forming apparatus according to claim 1, further comprising a second connector, disposed at an outwardly protruding area of said electrical equipment unit, said second connector being configured to connect to a connector of a relay substrate of a laser scanner.

22. An image forming apparatus according to claim 1, further comprising a second connector, disposed at an outwardly protruding area of said electrical equipment unit, said second connector being configured to connect to a connector of a contact electrode of a recording medium supply unit.

23. An image forming apparatus according to claim 1, wherein said first electrical contact comprises a contact spring.

24. An image forming apparatus according to claim 1, wherein said second electrical contact comprises a contact spring.

25. An image forming apparatus according to claim 1, wherein said third electrical contact comprises a contact spring.

26. An image forming apparatus according to claim 1, wherein said connector comprises an AC connector and a DC connector configured to connect respectively to an AC connector and a DC connector of said fixing means, within an area smaller than a width of the maximum size recording medium.

27. An image forming apparatus according to claim 1, wherein a connection between said connector and said fixing means is movable by about 0.5 mm to 1.0 mm in X, Y, and Z directions.

28. An image forming apparatus according to claim 1, further comprising an upper body and a lower body which are dividable and openable with respect to each other, wherein the process cartridge is mountable on said mounting means in said upper body, and wherein said electrical equipment unit is mounted in said lower body.

29. An image forming apparatus according to claim 1, wherein said electrical equipment unit comprises a power source on a single printed substrate.

30. An image forming apparatus according to claim 1, wherein said electrical equipment unit comprises an electrical circuit on a single printed substrate.

31. An image forming apparatus according to claim 1, wherein said electrical equipment unit comprises a power source and an electrical control circuit, both on a single printed substrate.

* * * * *

UNITED STATES PATENT AND TRADEMARK OFFICE

CERTIFICATE OF CORRECTION

PATENT NO. : 5,561,499

DATED : October 1, 1996

INVENTOR(S) : TAKESHI SETORIYAMA

It is certified that error appears in the above-indentified patent and that said Letters Patent is hereby corrected as shown below:

On the title page, item:

[57] ABSTRACT:

Line 6, "tile" should read --the--.

SHEET 5 OF THE DRAWINGS:

Figure 5, "SUPRLY" should read --SUPPLY--.

COLUMN 1:

Line 57, "considerably.." should read --considerably.--.

COLUMN 4:

Line 11, "by-fitting" should read --by fitting--.

COLUMN 5:

Line 48, "Furthermore,," should read --Furthermore,--;

and

Line 51, "cartridge,." should read --cartridge.--.

UNITED STATES PATENT AND TRADEMARK OFFICE

CERTIFICATE OF CORRECTION

PATENT NO. : 5,561,499 Page 2 of 2

DATED : October 1, 1996

INVENTOR(S) : TAKESHI SETORIYAMA

It is certified that error appears in the above-indentified patent and that said Letters Patent is hereby corrected as shown below:

COLUMN 6:

Line 16, "there,by" should read --thereby--; and
Line 39, "tire" should read --the--.

Signed and Sealed this

Twenty-fifth Day of February, 1997

*Attest:*

*Attesting Officer*

BRUCE LEHMAN

*Commissioner of Patents and Trademarks*